US009382085B2

(12) United States Patent
Yen

(10) Patent No.: US 9,382,085 B2
(45) Date of Patent: Jul. 5, 2016

(54) APPARATUS FOR IDENTIFYING AND GLUING THE FINAL EDGE OF A LOG MATERIAL

(71) Applicant: CHAN LI MACHINERY CO., LTD., Taoyuan (TW)

(72) Inventor: Yung Shui Yen, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 87 days.

(21) Appl. No.: 14/246,416

(22) Filed: Apr. 7, 2014

(65) Prior Publication Data

US 2015/0020976 A1 Jan. 22, 2015

(30) Foreign Application Priority Data

Jul. 17, 2013 (TW) ..... 102125519 A

(51) Int. Cl.
*B32B 41/00* (2006.01)
*B65H 19/29* (2006.01)

(52) U.S. Cl.
CPC ..... *B65H 19/29* (2013.01); *B65H 2301/41244* (2013.01); *B65H 2301/41441* (2013.01); *B65H 2301/41722* (2013.01); *B65H 2301/414446* (2013.01); *B65H 2301/4461* (2013.01); *B65H 2301/44312* (2013.01); *B65H 2404/1532* (2013.01); *B65H 2404/233* (2013.01); *B65H 2404/261* (2013.01); *B65H 2406/122* (2013.01); *B65H 2511/514* (2013.01); *B65H 2553/00* (2013.01); *B65H 2701/1842* (2013.01)

(58) Field of Classification Search
CPC ..... B65H 19/29; B65H 2301/44312; B65H 2406/122; B65H 2404/1532; B65H 2301/4461; B65H 2553/00; B65H 2404/233; B65H 2301/41441; B65H 2404/261; B65H 2701/1842; B65H 2301/414446; B65H 2301/41244; B65H 2301/41722; B65H 2511/514
USPC ..... 156/64, 184, 187, 302, 350, 357, 360, 156/361, 446, 449, 455, 519
See application file for complete search history.

(56) References Cited

U.S. PATENT DOCUMENTS

| | | | | |
|---|---|---|---|---|
| 5,242,525 | A * | 9/1993 | Biagiotti | B65H 19/29 156/184 |
| 2004/0144495 | A1* | 7/2004 | Gambini | B65H 19/29 156/446 |
| 2010/0154976 | A1* | 6/2010 | Gambini | B65H 19/29 156/152 |

* cited by examiner

*Primary Examiner* — Michael N Orlando
*Assistant Examiner* — Joshel Rivera
(74) *Attorney, Agent, or Firm* — Rosenberg, Klein & Lee

(57) ABSTRACT

An apparatus for identifying and gluing the final edge of a log of web material is disclosed. The apparatus of the present invention uses an upper unwinding roller, a lower unwinding roller, an unwinding nozzle, and an unwinding detector for identifying the final edge of the log of web material. The log of web material is transferred by an upper belt and a lower belt to a gluing module for gluing the final edge to the log of web material.

12 Claims, 7 Drawing Sheets

APPARATUS FOR IDENTIFYING AND GLUING THE FINAL EDGE OF A LOG MATERIAL

FIELD OF THE INVENTION

The present invention relates to an apparatus for identifying and gluing the final edge of a log of web material.

BACKGROUND OF THE INVENTION

Nowadays, a machine for gluing the final edge of a log of web material uses a stage of structures to identify the final edge of the log of web material, and then transfers the web material to another stage for gluing the final edge of the log of web material.

In general, the identification of the final edge of a log of web material takes more time in operation. After the final edge is identified, the relative position of the final edge and the web material should be maintained during the transformation between the stages, and then the final edge can be glued at the correct position. For maintaining the relative position of the final edge and the web material, the speed of transformation cannot be high. That the identification and gluing of the final edge are usually the bottleneck of production processes.

Some manufacturers calculate the length of the web material or winds of the log of web material, glue at a predetermined location, and then cut the web material after the glued location. In this case, the process of the final edge identification is omitted. But a log of web material with glued final edge is unfavorable for storage. The glue may deteriorate and go off during long-term storage. Moreover, the glue on the final edge may splash down and pollute the equipments.

SUMMARY OF THE PRESENT INVENTION

It is an objective of the present invention to provide an apparatus for identifying and gluing the final edge of a log of web material.

It is another objective of the present invention to provide an apparatus with special configuration of rollers and belts for quickly and reliably identifying and gluing the final edge of a log of web material.

It is still another objective of the present invention to provide an apparatus for identifying and gluing the final edge of a log of web material, in which the glue is laid on the web material and is covered with the final edge for preventing the pollution of product and equipments.

The present invention provides an apparatus for identifying and gluing a final edge of a log of web material, comprising: a loading track for introducing a plurality of logs of web material into the apparatus; an introducing means having a plurality of blades, wherein each blade is adjacent to the introducing track at a loading position for loading one of the plurality of logs of web material and unloads the web material at a unloading position; a lower belt disposed on a first lower roller and a second lower roller, wherein the first lower roller is disposed adjacent to the unloading position for the lower belt to bear the web material unloaded by the introducing means; a gluing module disposed adjacent to the second lower roller for gluing the log of web material, wherein a gap is formed between the gluing module and the second lower roller; a upper belt disposed on a first upper roller and a second upper roller, wherein the upper belt is located above the lower belt and the gluing module and moves in the same speed and direction with the lower belt; an upper unwinding roller disposed coaxially with the first upper roller with a diameter slightly greater than a diameter of the first upper roller; a lower unwinding roller disposed under the upper unwinding roller with an upper edge slightly higher than the lower belt, wherein the lower unwinding roller rotates in the same speed and direction with the upper unwinding roller; a first unwinding nozzle disposed adjacent to the upper unwinding roller with a blowing direction tangent to the log of web material when the web material touches the upper unwinding roller; an unwinding detector disposed behind the upper unwinding roller for detecting a final edge of a log of web material; and an unloading track disposed adjacent to the gluing module for unloading a glued log of web material.

In one embodiment of the present invention, the upper unwinding roller is driven independently.

In one embodiment of the present invention, the apparatus further comprises a loading detector disposed above the loading position for detecting the web material.

In one embodiment of the present invention, the lower belt is a suction belt.

In one embodiment of the present invention, the lower belt is a perforated belt and a suction blower is disposed under the belt and between the lower unwinding roller and the second lower roller.

In one embodiment of the present invention, the apparatus further comprises a gap nozzle disposed above the second lower roller with a blowing direction towards the gap.

In one embodiment of the present invention, the apparatus further comprises a gap detector disposed above the second lower roller for detecting the web material.

In one embodiment of the present invention, the apparatus further comprises a gluing plate disposed between the gluing module and the unloading track and under the upper belt.

In one embodiment of the present invention, the apparatus further comprises a gluing roller disposed under the gluing plate with an upper edge slightly higher than the gluing plate, wherein the gluing roller rotates in the same speed and direction with the second upper roller.

In one embodiment of the present invention, the apparatus further comprises an unloading detector disposed above the unloading position.

In one embodiment of the present invention, the apparatus further comprises an introducing detector disposed above the introducing track.

In one embodiment of the present invention, the apparatus further comprises a second unwinding nozzle disposed in front of the upper unwinding roller with a blowing direction tangent to the log of web material behind the touch point of the upper unwinding roller and the web material.

In one embodiment of the present invention, the upper edge of the lower unwinding roller is located in front of the first lower roller.

DETAILED DESCRIPTION OF THE PREFERRED EMBODIMENTS

Figure 1:
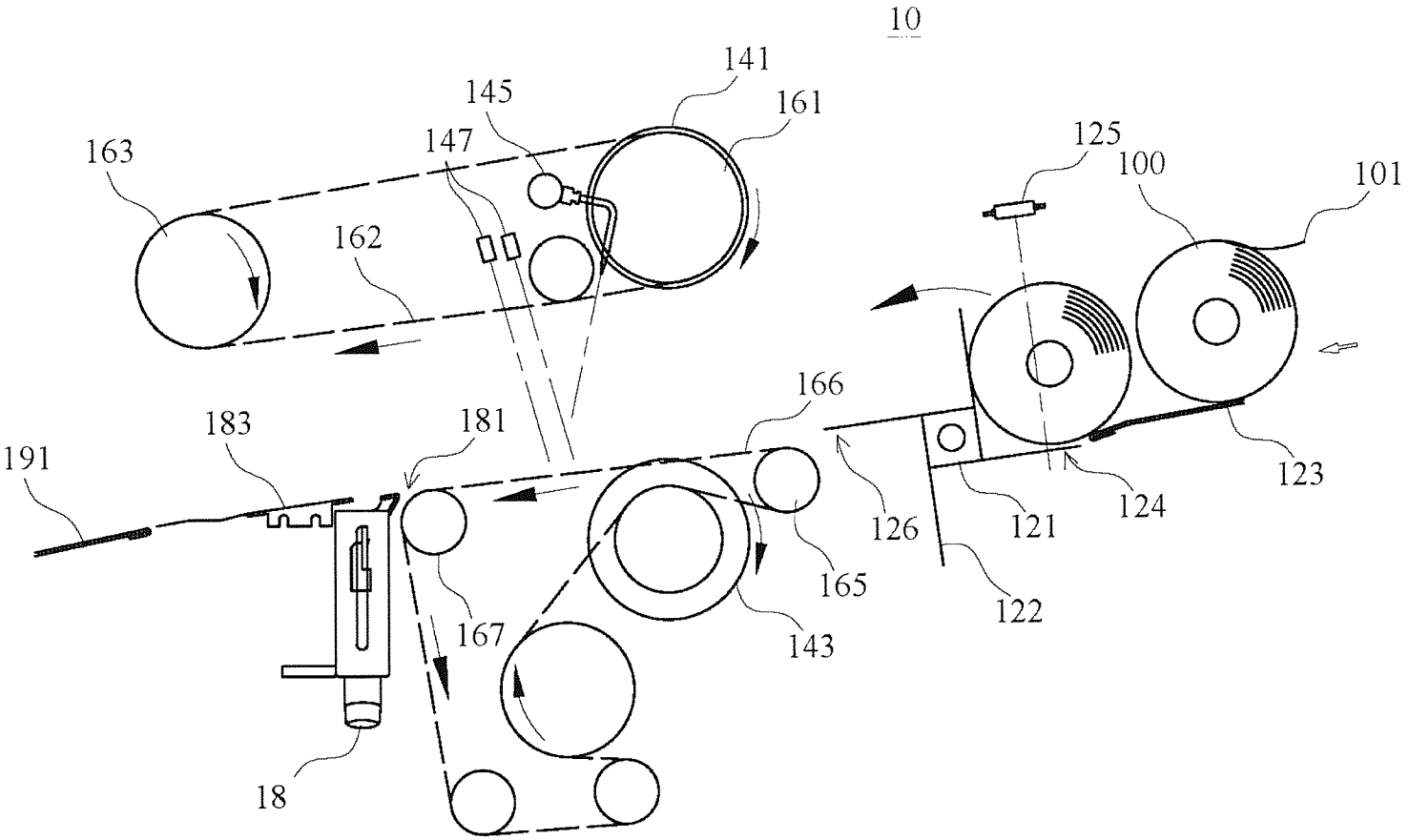
FIGS. 1-5 are schematic drawings illustrating the operational steps of an apparatus for identifying and gluing the final edge of a log of web material in accordance with one embodiment of the present invention.

Referring to FIGS. 1-5, the operational steps of an apparatus for identifying and gluing the final edge of a log of web material in accordance with one embodiment of the present invention are illustrated. In the present embodiment, the apparatus 10 for identifying and gluing the final edge of a log of web material comprises a track 123, an introducing means 121, a lower belt 166, a gluing module 18, an upper belt 162, an upper unwinding roller 141, a lower unwinding roller 143, a blowing nozzle 145, at least one detector 147, and a track 191.

The introducing means 121 comprises a plurality of blades 122. Each blade 122 can be fed with a log of web material 100 at the loading position 124 adjacent to the track 123 and transfers the of web material 100 to the lower belt 166 at the unloading position 126. The lower belt 166 is disposed on the first lower roller 165 and the second lower roller 167. The first lower roller 165 is disposed adjacent to the unloading position 126. The operation region of the lower belt 166 is configured between the upper edges of the first and second lower roller 165 and 167. The operation region of the lower belt 166 moves in the direction from the front end (track 123) to the back end (track 191).

The gluing module 18 is disposed adjacent to the second lower roller 167, and there is a gap 181 between the gluing module 18 and the lower belt 166. When a log of web material 100 goes through the gluing module 18, some glue is transferred to the log of web material 100. The track 191 is disposed adjacent to the gluing module 18 for the glued log of web material 100 to pass through.

The upper belt 162 is disposed on the first upper roller 161 and the second upper roller 163. The operation region of the upper belt 162 is configured between the lower edges of the first and second upper roller 161 and 163. The operation region of the upper belt 162 is disposed above the operation region of the lower belt 166 and the gluing module 18, and moves in the same speed and direction with the operation region of the lower belt 166. Such that, the log of web material 100 with the identified final edge 101 is clamped by the upper belt 162 and the lower belt 166 to move to the gluing module 18 without rotation.

The upper unwinding roller 141 is disposed coaxially with the first upper roller 161 with the diameter slightly greater than the diameter of the first upper roller 161. The lower edge of the upper unwinding roller 141 is lower than the operation region of the upper belt 162. The lower unwinding roller 143 is disposed under the upper unwinding roller 141 with the upper edge of the lower unwinding roller 143 slightly higher than the operation region of the lower belt 166.

The blowing nozzle 145 is disposed near the upper unwinding roller 141 with the blowing direction tangent to the web material 100 when the log of web material 100 touches the upper unwinding roller 141. The detector 147 is disposed behind the upper unwinding roller 141 for detecting the final edge 101 of the log of web material 100.

Figure 2:
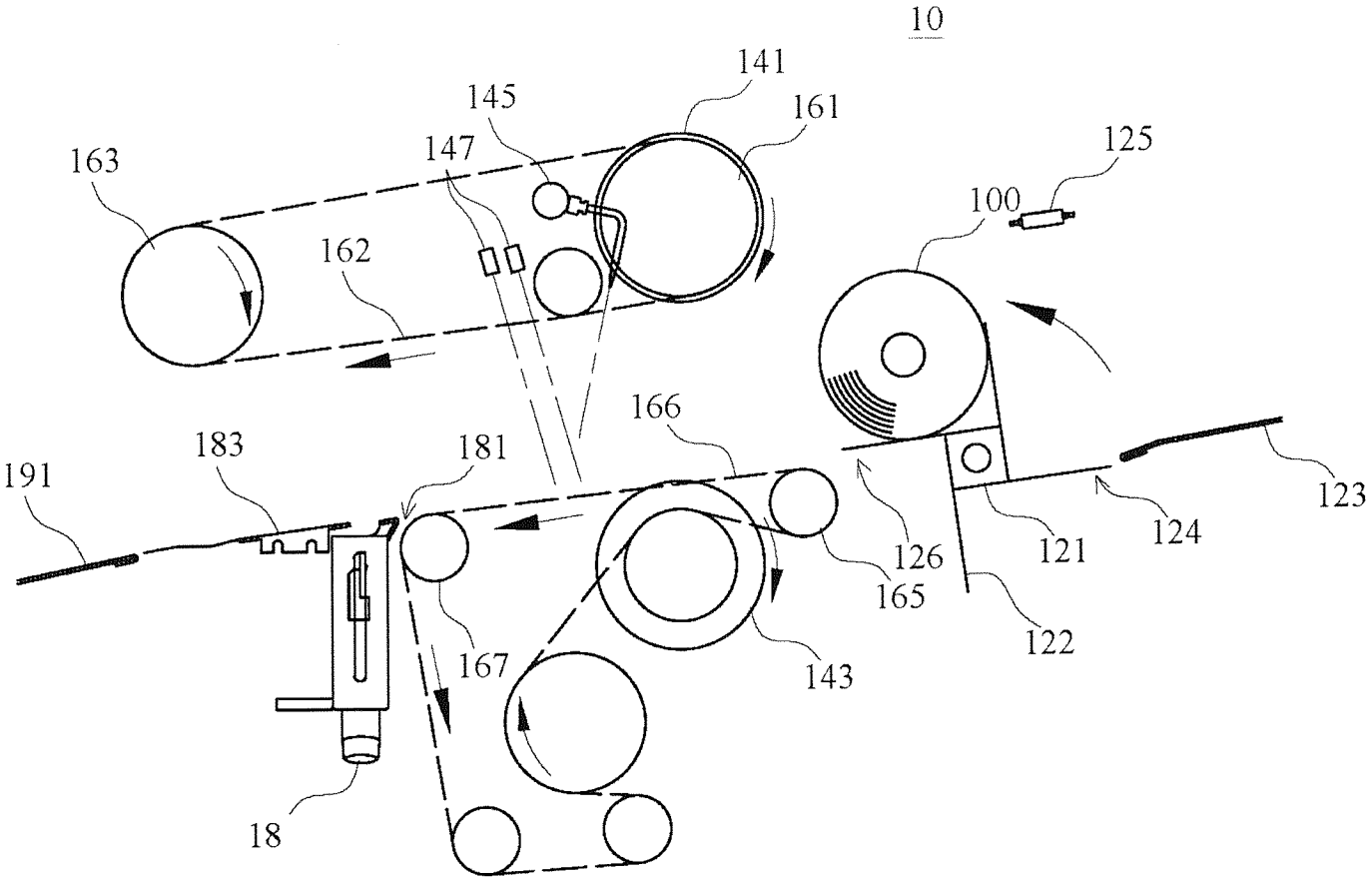

When a log of web material 100 goes into the introducing means 121, it is borne by the blade 122 at the loading position 124. Then the introducing means 121 rotates, and the blade 122 comes to the unloading position 126, as shown in FIGS. 1 and 2.

Figure 3:
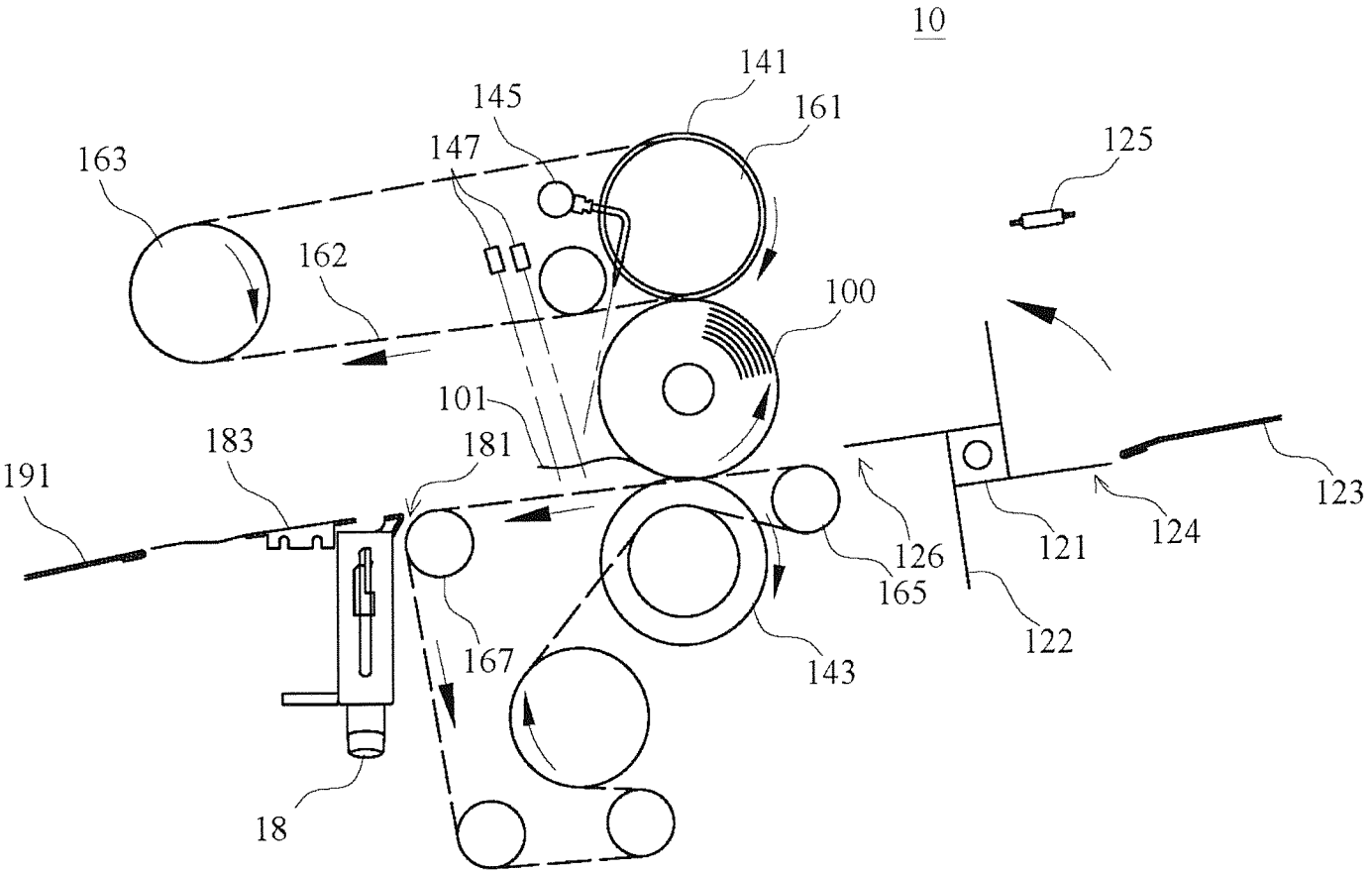

The log of web material 100 is transferred to the lower belt 166 from the blade 122 at the unloading position 126. Since the lower edge of the upper unwinding roller 141 is lower than the operation region of the upper belt 162 and the upper edge of the lower unwinding roller 143 is higher than the operation region of the lower belt 166, the web material 100 on the lower belt 166 touches the upper unwinding roller 141 and the lower unwinding roller 143 during transformation. When the upper unwinding roller 141 and the lower unwinding roller 143 rotate in the same speed and direction (clockwise in the present embodiment), the web material 100 is driven to rotate anti-clockwise at the position where the of web material 100 touches the upper unwinding roller 141 and the lower unwinding roller 143. When the web material 100 rotates, the blowing nozzle 145 blows tangentially to the log of web material 100, and the final edge 101 will be blown out of the log of web material 100, as shown in FIG. 3.

In one embodiment of the present invention, the upper unwinding roller 141 is driven and controlled independently. The upper unwinding roller 141 can be controlled to rotate clockwise, anti-clockwise, or stop independently.

Figure 4:
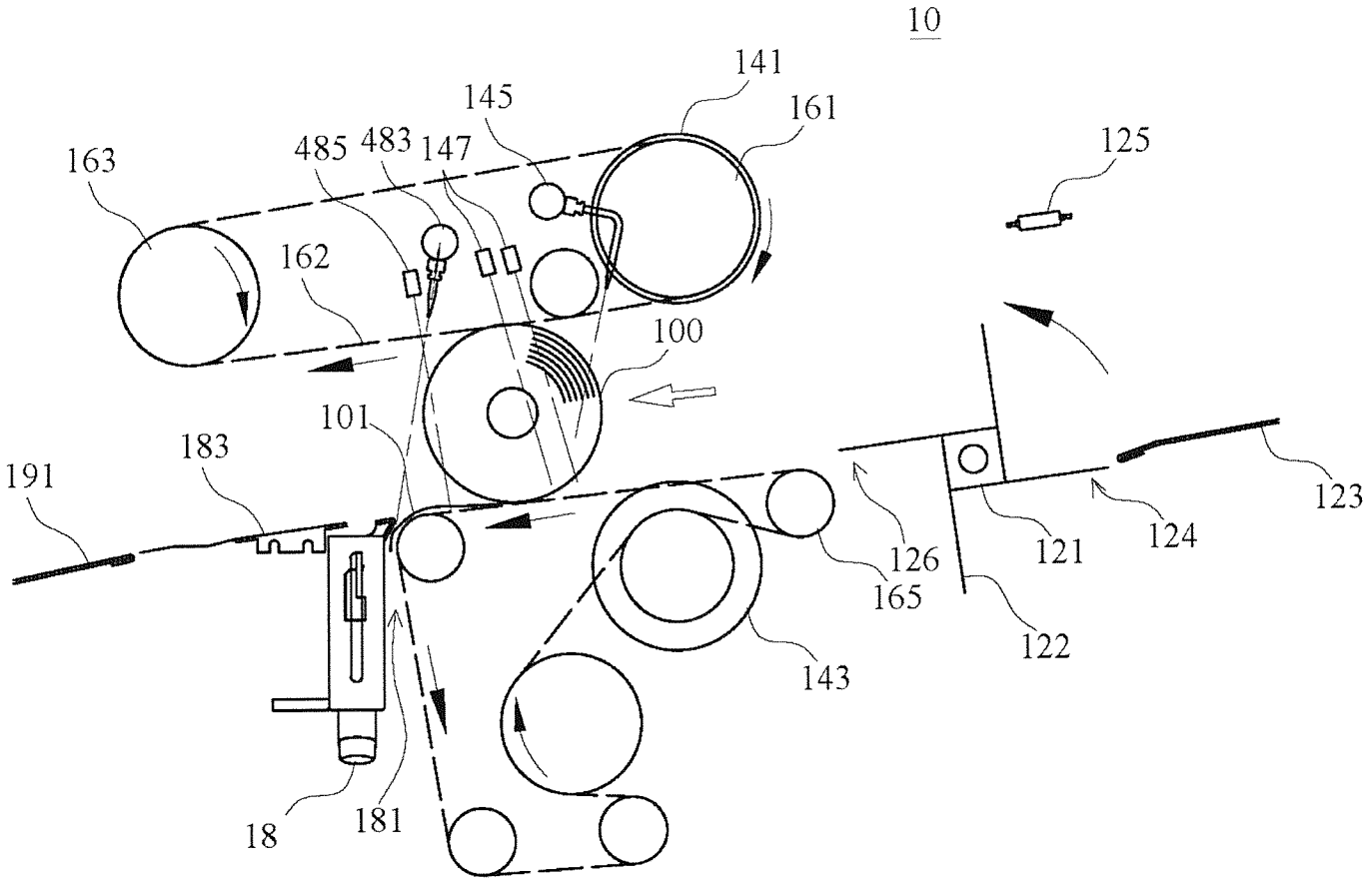

When the detector 147 detects the final edge 101, the lower unwinding roller 143 is controlled to stop. The web material 100 is driven by the upper unwinding roller 141 to cross the lower unwinding roller 143 and is clamped and moved by the upper belt 162 and the lower belt 166. The final edge 101 is blown by the blowing nozzle 145 and adheres to the lower belt 166, and then moves with the lower belt 166 into the gap 181, as shown in FIG. 4. In the present embodiment, the log of web material 100 is clamped by the upper belt 162 and the lower belt 166 right after the final edge 101 is identified, no rotation occurs during transformation, that the relative position of the final edge 101 and the log of web material 100 is maintained.

In one embodiment of the present invention, a blowing nozzle 483 is disposed above the second lower roller 167 with the blowing direction toward the gap 181. In the present embodiment, the blowing nozzle 483 blows to help the final edge 101 to go into the gap 181.

In one embodiment of the present invention, a detector 485 is disposed above the second lower roller 167 for detecting the position of the web material 100. In the present embodiment, the blowing nozzle 483 blows the final edge 101 into the gap 181 when the detector 485 detects the web material 100. On the other hand, once the log of web material 100 is detected by the detector 485 that means that the identification of the final edge 101 is completed and the log of web material 100 is going to the gluing module 18. If there is a log of web material 100 in the introducing means 121 at the loading position 124, the introducing means 121 rotates to transfer the log of web material 100 to the unloading position 126 for identifying the final edge 101.

By using the apparatus 10 of the present invention, time for production is greatly reduced.

Figure 5:
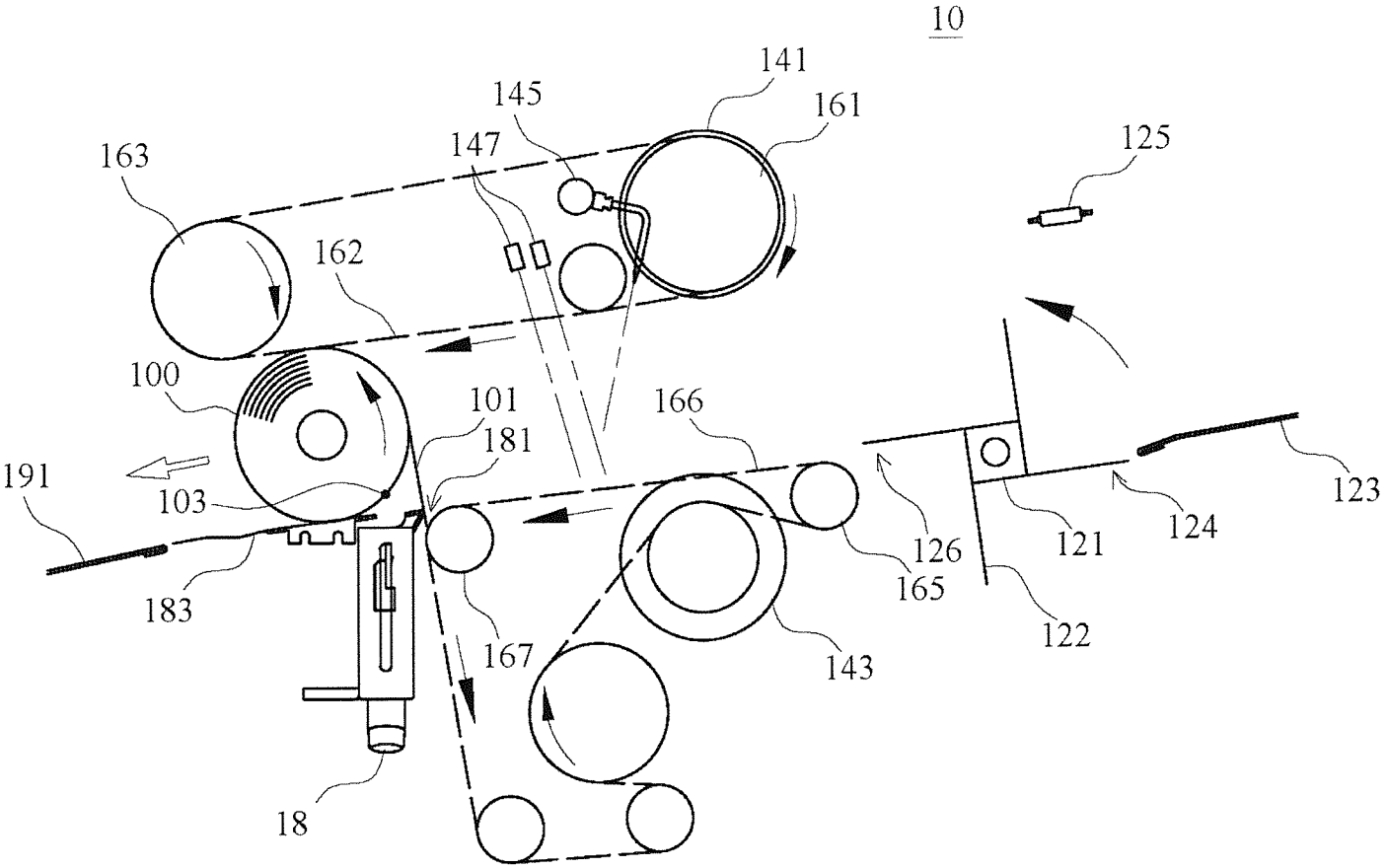

When the log of web material 100 passes through the second lower roller 167, it is driven by the upper belt 162 to roll through the gluing module 18. Meanwhile, some glue is transferred to the gluing point 103 of the web material 100 by the gluing module 18, and the final edge 101 is brought out from the gap 181 and covers over the gluing point 103. And then, the operation of gluing is completed, as shown in FIG. 5. By using the present invention, the glue is transferred to the web material 100 and is covered by the final edge 101, that the equipments will not be polluted by the glue.

In one embodiment of the present invention, a detector 125 (shown in FIG. 1) is disposed above the loading position 124 for detecting the web material 100. When a log of web material 100 is detected by the detector 125 and the final edge 101 identification of the previous log of web material 100 is completed, the introducing means 121 rotates and transfers the log of web material 100 for final edge 101 identification.

In one embodiment of the present invention, a gluing plate 183 (shown in FIG. 1) is disposed between the gluing module 18 and the track 191 and under the operation region of the upper belt 162. In the present embodiment, the glued log of web material 100 is driven by the upper belt 162 to roll through the gluing plate 183 for gluing the final edge 101 tight to the of web material 100.

Figure 6:
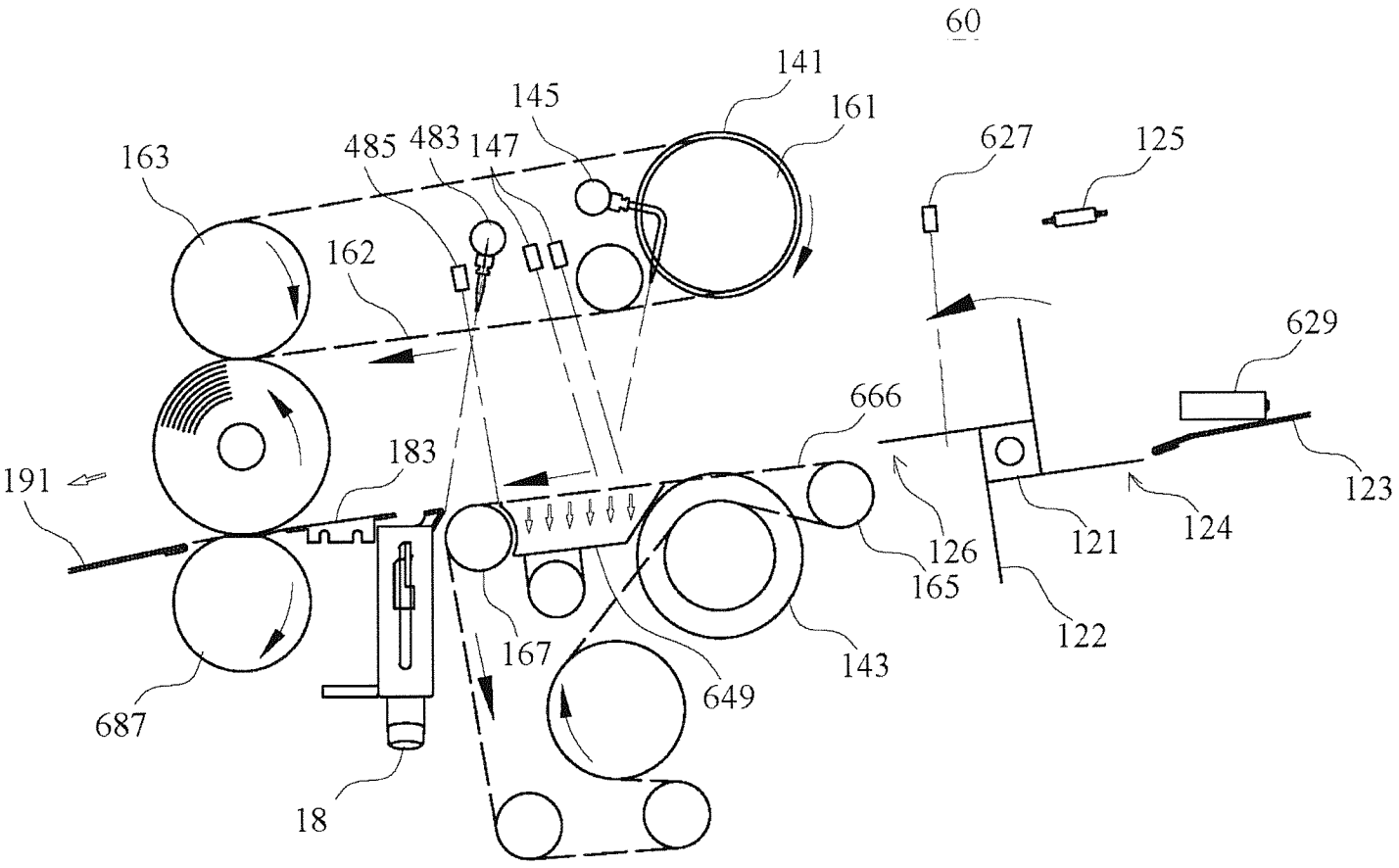
FIG. 6 is a schematic diagram of an apparatus for identifying and gluing the final edge of a log of web material in accordance with another embodiment of the present invention.

Referring to FIG. 6, there is shown a schematic diagram of an apparatus for identifying and gluing the final edge of a log of web material in accordance with another embodiment of the present invention. As shown in the figure, the apparatus 60 of the present embodiment comprises some structures to improve the abovementioned embodiment.

In one embodiment of the present invention, the lower belt is a suction belt 666. In the present embodiment, once the final edge 101 is blown out of the log of web material 100, it will be socked and attached to the belt 666 and move with the belt 666 into the gap 181. The suction belt 666 can be embodied by a perforated belt with a suction blower 649 disposed under the belt 666 and between the lower unwinding roller 143 and the second lower roller 167.

In one embodiment of the present invention, a gluing roller 687 is disposed under the gluing plate 183 with the upper edge of the gluing roller 687 slightly higher than the gluing plate 183. The gluing roller 687 rotates in the same speed and direction with the second upper roller 163 (clockwise in the present embodiment). In the present embodiment, the glued log of web material 100 rotates at the position where the web material 100 touches the gluing roller 687 for gluing the final edge 101 tight to the log of web material 100.

In one embodiment of the present invention, a detector 627 is disposed above the unloading position 126. When a log of web material 100 is detected by the detector 627, the upper unwinding roller 141, the lower unwinding roller 143, the upper belt 162 and the lower belt 666 start to operate for the final edge 101 identification.

In one embodiment of the present invention, a detector 629 is disposed above the track 123 for detecting web material 100.

Figure 7:
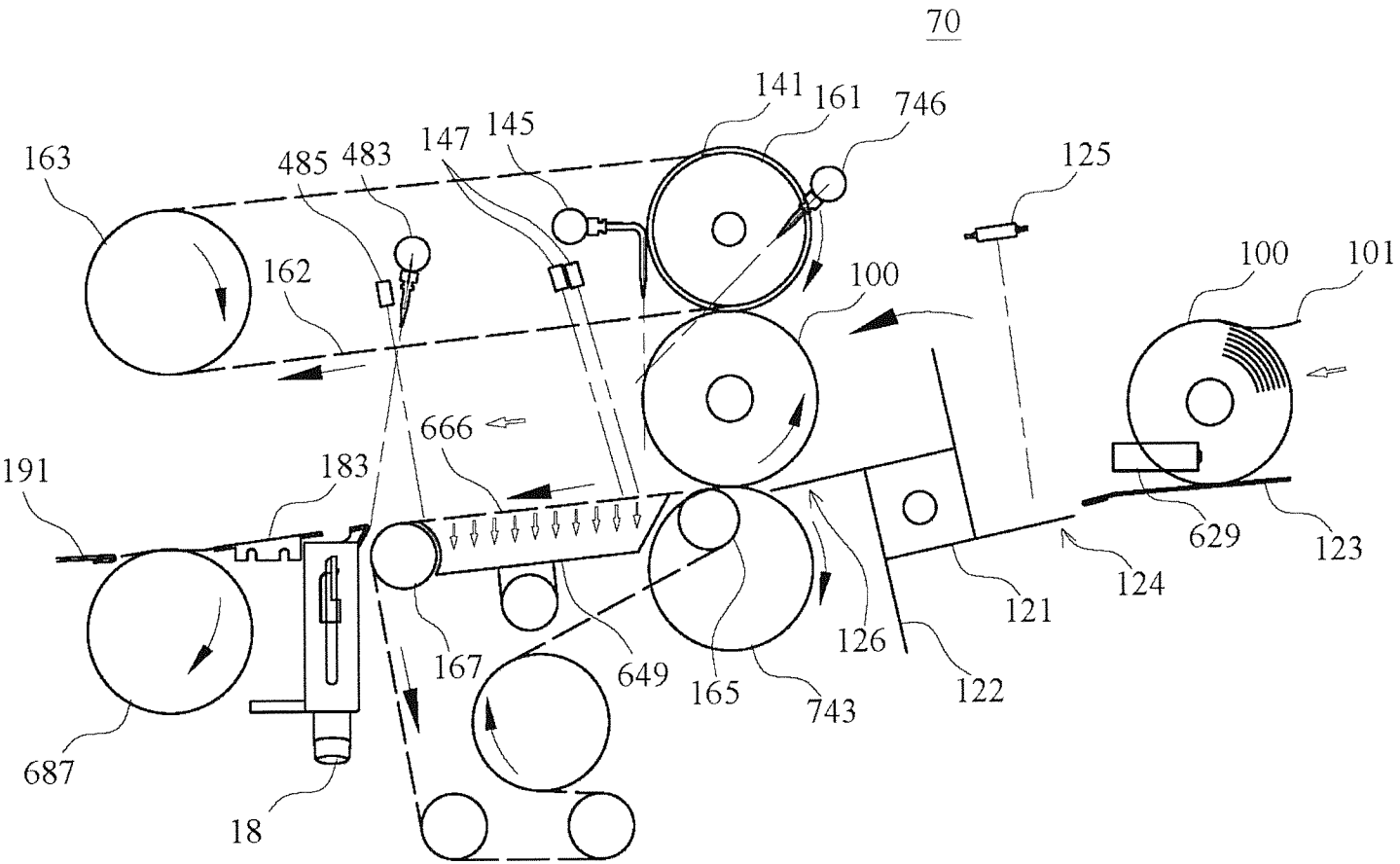
FIG. 7 is a schematic diagram of an apparatus for identifying and gluing the final edge of a log of web material in accordance with still another embodiment of the present invention.

Referring to FIG. 7, there is shown a schematic diagram of an apparatus for identifying and gluing the final edge of a log of web material in accordance with one embodiment of the present invention.

In one embodiment of the present invention, a blowing nozzle 746 is disposed in front of the upper unwinding roller 141 with the blowing direction tangent to the log of web material 100 behind the touch point of the upper unwinding roller 141 and the web material 100. In the present embodiment, the final edge 101 of the log of web material 100 can be blown out of the log of web material 100 much quickly.

In one embodiment of the present invention, the upper edge of the lower unwinding roller 743 is disposed in front of the first lower roller 165. Once the introducing means 121 unloads the log of web material 100, the apparatus 70 starts to identify the final edge 101 of the log of web material 100.

By using the apparatus of the present invention, the space for installing the apparatus is greatly reduced, and the time for production is shortened.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An apparatus for identifying and gluing a final edge of a log of web material, comprising:

an introducing track for introducing a plurality of logs of web material into the apparatus;

an introducing means having a plurality of blades, wherein each blade is loaded with one of the plurality of logs of web material at a loading position adjacent to the introducing track and unloads the log of web material at a unloading position;

a lower belt disposed on a first lower roller and a second lower roller, wherein the first lower roller is disposed adjacent to the unloading position for the lower belt to bear the log of web material unloaded by the introducing means;

a gluing module disposed adjacent to the second lower roller for gluing the log of web material, wherein there is a gap between the gluing module and the second lower roller;

an upper belt disposed on a first upper roller and a second upper roller, wherein the upper belt is located above the lower belt and the gluing module and moves in the same speed and direction with the lower belt;

an upper unwinding roller disposed coaxially with the first upper roller with a diameter slightly greater than a diameter of the first upper roller;

a lower unwinding roller disposed under the upper unwinding roller with an upper edge slightly higher than the lower belt, wherein the lower unwinding roller rotates in the same speed and direction with the upper unwinding roller;

a first unwinding nozzle disposed near the upper unwinding roller with a blowing direction tangent to the log of web material when the log of web material touches the upper unwinding roller;

an unwinding detector disposed behind the upper unwinding roller for detecting the final edge of the log of web material;

an unloading track disposed adjacent to the gluing module for unloading a glued log of web material; and a gap nozzle disposed above the second lower roller with a blowing direction towards the gap.

2. The apparatus as claimed in claim 1, wherein the upper unwinding roller is driven independently.

3. The apparatus as claimed in claim 1, further comprising a loading detector disposed above the loading position for detecting the log of web material.

4. The apparatus as claimed in claim 1, wherein the lower belt is a suction belt.

5. The apparatus as claimed in claim 1, wherein the lower belt is a perforated belt and a suction blower is disposed under the belt and between the lower unwinding roller and the second lower roller.

6. The apparatus as claimed in claim 1, further comprising a position detector disposed above the second lower roller for detecting the log of web material.

7. The apparatus as claimed in claim 1, further comprising a gluing plate disposed between the gluing module and the unloading track and under the upper belt.

8. The apparatus as claimed in claim 7, further comprising a gluing roller disposed under the gluing plate with an upper edge slightly higher than the gluing plate, wherein the gluing roller rotates in the same speed and direction with the second upper roller.

9. The apparatus as claimed in claim 1, further comprising an unloading detector disposed above the unloading position.

10. The apparatus as claimed in claim 1, further comprising an introducing detector disposed above the introducing track.

11. The apparatus as claimed in claim 1, further comprising a second unwinding nozzle disposed in front of the upper unwinding roller with a blowing direction tangent to the log of web material behind the touch point of the upper unwinding roller and the log of web material.

12. The apparatus as claimed in claim 1, wherein the upper edge of the lower unwinding roller is located in front of the first lower roller.

* * * * *